US010138562B2

(12) United States Patent
Riskin et al.

(10) Patent No.: US 10,138,562 B2
(45) Date of Patent: Nov. 27, 2018

(54) METHOD FOR CONVERSION OF WATER INTO HYDROGEN PEROXIDE AND CONVERTER

(71) Applicants: Yefim Riskin, Katzrin (IL); Leonid Riskin, Ma'alot (IL)

(72) Inventors: Yefim Riskin, Katzrin (IL); Leonid Riskin, Ma'alot (IL)

( * ) Notice: Subject to any disclaimer, the term of this patent is extended or adjusted under 35 U.S.C. 154(b) by 229 days.

(21) Appl. No.: 15/221,972

(22) Filed: Jul. 28, 2016

(65) Prior Publication Data

US 2017/0335471 A1 Nov. 23, 2017

(30) Foreign Application Priority Data

May 18, 2016 (IL) ..... 245718

(51) Int. Cl.

| | |
|---|---|
| ***C25B 1/30*** | (2006.01) |
| ***C25B 9/04*** | (2006.01) |
| ***C25B 9/12*** | (2006.01) |
| ***C25B 15/08*** | (2006.01) |
| ***C25B 15/02*** | (2006.01) |

(52) U.S. Cl.

CPC ..... *C25B 1/30* (2013.01); *C25B 9/04* (2013.01); *C25B 9/125* (2013.01); *C25B 15/02* (2013.01); *C25B 15/08* (2013.01)

(58) Field of Classification Search

CPC ..... A61L 9/03; A61L 9/22; A61L 2209/211; B01J 2219/0875; B01J 2219/0809; B01J 2219/0818; B01J 2219/083; B01J 2219/0849; B01J 2219/0898; B01J 2219/0884; C25B 9/125; C25B 9/04; C25B 1/30

See application file for complete search history.

(56) References Cited

U.S. PATENT DOCUMENTS

| | | | | |
|---|---|---|---|---|
| 3,440,800 A | | 4/1969 | Messen-Jaschin | |
| 4,832,918 A | * | 5/1989 | Horikoshi | C01B 13/11 422/186.07 |

(Continued)

FOREIGN PATENT DOCUMENTS

| | | |
|---|---|---|
| DE | 10 2009 017807 A1 | 11/2009 |
| EP | 2 404 621 A1 | 1/2012 |

(Continued)

OTHER PUBLICATIONS

Kirkpatrick et al.Ind. Eng. Chem. Res. 2005, 44, 4243-4248 (Year: 2005).*

(Continued)

*Primary Examiner* — Gurpreet Kaur

(74) *Attorney, Agent, or Firm* — Kelly & Kelley, LLP

(57) ABSTRACT

A method and device for conversion of water into hydrogen peroxide, wherein a corona discharge zone is generated between a rotating electrode formed as a hollow rotor of a centrifugal fan and a fixed electrode. The rotating electrode is rotated relative to an insulation layer of the fixed electrode, and high voltage AC power is applied to the fixed electrode while conveying vapor through the corona discharge zone. In one aspect, the novelty resides in using the rotating electrode for conversion of water to vapor. In another aspect, conductivity between the two electrodes induces electrolysis, which is used for high voltage AC transmission to the rotating electrode.

16 Claims, 2 Drawing Sheets

(56) References Cited

U.S. PATENT DOCUMENTS

| | | | |
|---|---|---|---|
| 5,380,355 | A | 1/1995 | Brothers |
| 2009/0098062 | A1 | 4/2009 | Bobbert |
| 2017/0335471 | A1 | 11/2017 | Riskin |

FOREIGN PATENT DOCUMENTS

| | | | |
|---|---|---|---|
| KR | 20020014199 | A | 2/2002 |
| WO | 96/32175 | A2 | 10/1996 |
| WO | 2007/130852 | A2 | 11/2007 |
| WO | 2016/103246 | A1 | 6/2016 |

OTHER PUBLICATIONS

Locke B. R. et al. "Review of the methods to form hydrogen peroxide in electrical discharge plasma with liquid water" (2011) Plasma Sources Sci. Technol. , vol. 20, No. 3, pp. 1-15, DOI:10.1088/0963-0252/20/3/034006; Apr. 12, 2011.

Lukes P. et al. "Hydrogen Peroxide and Ozone Formation in Hybrid Gas—Liquid Electrical Discharge Reactors" (2004) IEEE Transactions on Industry Applications, vol. 40, No. 1, pp. 60-67, D01:10.1109/TIA.2003.821799 (Feb. 26, 2004).

International Search Report and Written Opinion for the International Application No. PCT/IL2017/051159 dated Jan. 29, 2018.

* cited by examiner

METHOD FOR CONVERSION OF WATER INTO HYDROGEN PEROXIDE AND CONVERTER

FIELD OF THE INVENTION

This invention relates to methods and devices for generation of hydrogen peroxide ($H_2O_2$) suitable for industrial and domestic applications.

BACKGROUND OF THE INVENTION

WO/2016/103246 discloses method and device for generation of hydrogen peroxide which operate on the principle of conversion of water vapor to hydrogen peroxide by conveying the vapor through the corona discharge zone generated between a rotating electrode formed as a hollow rotor of a centrifugal fan and a fixed electrode. WO/2016/103246 does not relate to the manner of conversion of water into vapor, which is assumed to occur external to the device, electrically and mechanically independent thereof. The need for an external and independent source of water vapor increases costs.

Furthermore, the device disclosed in WO/2016/103246 requires the use of an air capacitor for conveying high voltage AC from a stationary power source to the rotating electrode. This complicates the construction and imposes limitations on the frequency of the high voltage AC source, which should exceed 30 kHz.

SUMMARY OF THE INVENTION

An object of the invention is to simplify and reduce the cost of a device for converting water to hydrogen peroxide.

This object is achieved through the use of a rotating electrode formed as a hollow rotor for conversion of water into vapor just before delivering it to the corona discharge zone generated between the rotating and fixed electrodes when high AC voltage is applied to them from a stationary power source.

To this end, the rotating electrode is positioned inside a fixed electrode at a specified distance from the insulation layer thereof, and water is fed from a reservoir to the rotating electrode cavity. As a result, water is converted to vapor due to water encountering the electrode rotating at a high speed which is brought to the corona discharge zone by the centrifugal force generated by the electrode.

In order to feed water from the reservoir to the rotating electrode cavity, there is provided a channel having a lower end located in the water reservoir and an upper end in the rotating electrode cavity. The water level in the channel is raised by a rotating screw thread mounted inside the channel on the lower end of the rotating electrode.

Such an arrangement obviates the need for a separate water to vapor converter. Furthermore, converting water to vapor immediately prior to conveying the vapor through the corona discharge zone serves to cool the electrodes by 2 to 5° C. owing to the water to vapor conversion which is an adiabatic process. In addition such an arrangement allows high voltage from a stationary AC power source to be fed directly to the rotating electrode without the need for an air capacitor owing to electrolysis of the water between the water feeding channel and the rotating electrode, which greatly increases the water conductivity and thereby enables high voltage from the AC high voltage source to be conducted through the water feeding channel to the rotating electrode. This requires forming the rotating electrode and the water feeding channel from electrically conductive materials.

The proposed method for conversion of water into hydrogen peroxide is much simpler and cheaper because of a number of multi-functional elements used for its implementation. Thus, the rotating electrode in addition to functioning as one of the electrodes generating the corona discharge zone also performs the water to vapor conversion. Likewise, the water feeding channel in addition to feeding water to the rotating electrode serves for high AC voltage transmission from a stationary power source to the rotating electrode.

A device realizing the proposed method comprises an AC high voltage power source with high and low voltage output terminals and a split housing, an upper section of which accommodates the following elements: a motor with power supply terminals and a shaft, and a rotating electrode formed as a hollow rotor of a centrifugal fan that is mounted on a shaft with a helical spiral wound around its lower end.

Furthermore, the upper section of the housing contains a fixed electrode with an insulation layer and a hydrogen peroxide reservoir and an opening for removing peroxide from the device. The lower section of the housing contains a water reservoir with a water-feeding opening and a channel for water transfer from the lower section of the housing to the upper section of the housing. The rotating electrode shaft with the surrounding helical spiral is located inside the channel.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1:
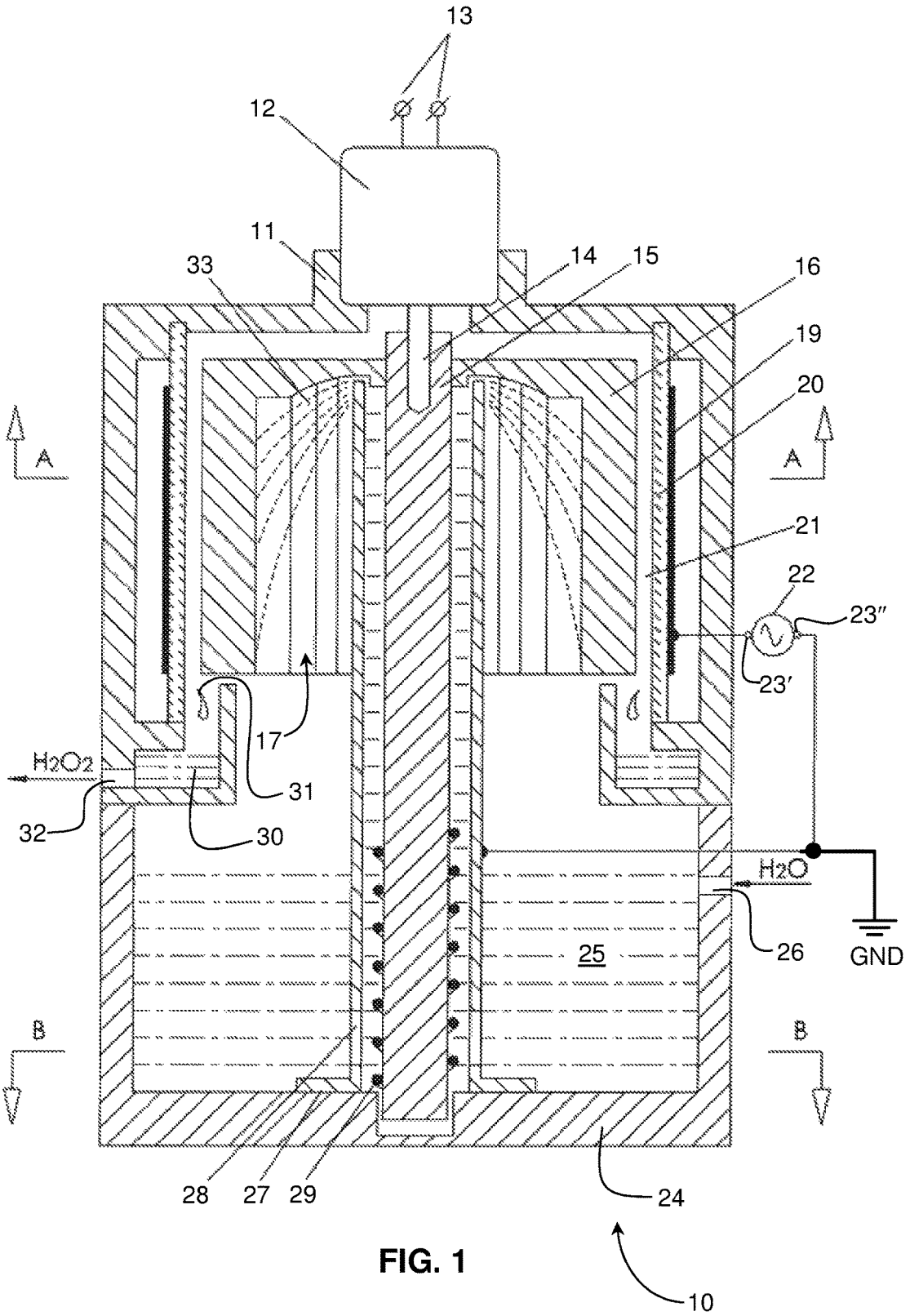
FIG. 1 illustrates schematically a device according to an embodiment of the invention for converting water to $H_2O_2$.
Figure 2:
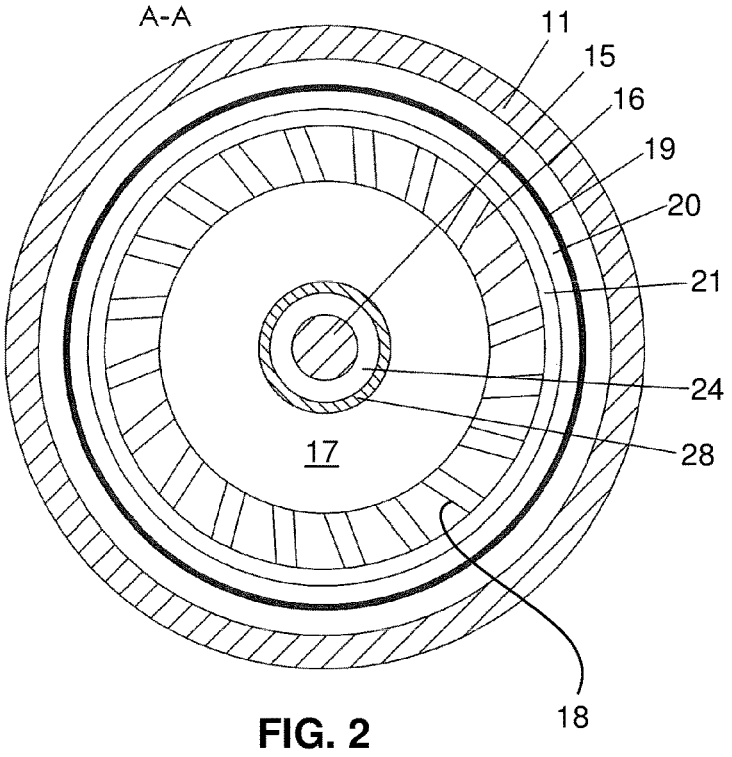
FIG. 2 shows a cross-section through line A-A in FIG. 1.
Figure 3:
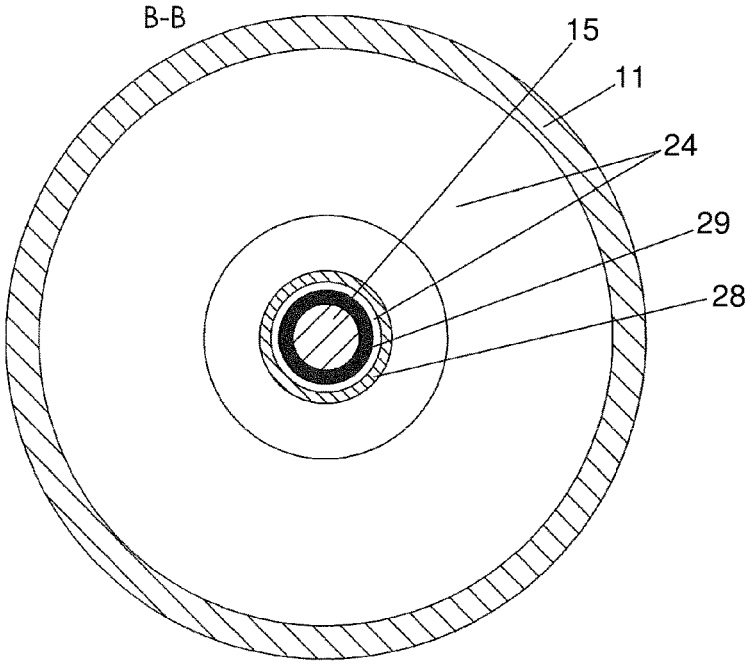
FIG. 3 shows a cross-section through line B-B in FIG. 1.

Referring to the figures there is shown a device 10 according to an embodiment of the invention for converting water to $H_2O_2$. The device 10 includes a split housing 11 containing at an upper end an electric motor 12 having power supply terminals 13 and a motor shaft 14 that is connected to an electrode shaft 15 rotatably mounted within the housing and which supports a rotating annular electrode 16 formed as a hollow rotor of a centrifugal fan having a cavity 17 and fan blades 18 (see FIG. 2). A fixed annular electrode 19 is mounted on an insulation layer 20 that is fixed within the housing 11 and displaced from the rotating electrode 16 so as to leave a gap 21. The fixed annular electrode 19 is adapted for coupling to an AC high voltage source 22 having a high voltage power supply terminal 23' and a low voltage terminal 23" that is shown connected to ground (GND). Also within the housing 11 is a water reservoir 24 into which water 25 may be fed via a water inlet 26 connected to an external water supply (not shown). Surrounding the electrode shaft 15 is a water supply channel 27, which is formed of electrically conductive material and is supported on a base of the housing and has toward its lower end an opening 28 that allows water from the reservoir 24 to flow into the water supply channel 27. A helical spiral 29 is wound round a lower end of the electrode shaft 15, whereby rotation of the electrode shaft 15 causes the helical spiral 29 to rotate and thereby raise the level of the water in the water supply channel 27. A peripheral hydrogen peroxide collection reservoir 30 is supported on an internal surface of the housing above the water reservoir 24 and directly beneath the gap 21 for collecting hydrogen peroxide 31 that is formed within the gap. Hydrogen peroxide is removed from the device via an outlet 32 formed in a wall of the housing 11.

The device 10 operates as follows: water 25 is fed to the reservoir 24 via the inlet 26, so that the water level in the reservoir 24 is lower than the level at the bottom of the hydrogen peroxide reservoir 30. Power is fed to the motor 12 from an external low voltage supply (not shown) and the AC high voltage power source 22 is connected between the fixed electrode 19 and the water supply channel 27 via the power supply terminals 23' and 23", respectively. Corona discharge is generated in the gap 21 between the rotating electrode 16 and the insulation layer 20 of the fixed electrode 19. The gap 21 thus constitutes a corona discharge zone. At the same time, owing to the presence of the helical spiral 29, water in the reservoir 24 is elevated to the upper level of the cavity 17 in the rotating electrode 16 via the opening 28 in the water supply channel 27 and is converted to vapor in a zone 33 toward the top of the cavity 17. The liquid to vapor conversion causes a drop in vapor temperature, which is used to cool the electrodes during the vapor transmission through the corona discharge zone.

The vapor is delivered to the corona discharge zone within the gap 21 by the centrifugal force created by the rotating electrode 16, where it is converted to hydrogen peroxide during high-energy electrolysis. This can be seen from FIG. 2 which shows that vapor in the cavity 17 is able to pass between the blades 18 of the rotor into the corona discharge zone in the gap 21. The centrifugal forces prevent from the vapor from settling on the rotating electrode 16 or from concentrating into drops on the insulation layer 20 on which the fixed electrode 19 is mounted.

A thin film of hydrogen peroxide is formed on the insulation layer 20, and rotates in a descending spiral until it escapes the corona discharge zone in the gap 21 whereupon the film of hydrogen peroxide is gradually destroyed and turns into droplets of hydrogen peroxide drops, which fall into the reservoir 30. The generated hydrogen peroxide is removed from the reservoir 30 to outside the device via the outlet 32.

It will be understood that prior to corona discharge between the fixed electrode 19 and the rotating electrode 16, the water supply channel 27 is at ground potential as is the rotating electrode 16. Application of high voltage AC between the fixed electrode 19 and the rotating electrode 16 raises the voltage on the rotating electrode 16 relative to the water supply channel 27 owing to the corona discharge which conveys charge from the fixed electrode 19 to the rotating electrode 16. Since the rotating electrode 16 is fixed to the shaft 15, which is itself formed of electrically conductive material, there is formed a potential difference between the electrode shaft 15 and the channel 27, which remains at ground potential. This potential difference induces electrolysis of the water inside the channel 27, with the result that the electrical conductivity of the water in the channel greatly increases by a factor of several thousand and provides a low-resistance contact between the water supply channel 27 and the shaft 15 of the rotating electrode 16. This low-resistance contact enables high voltage from the AC high voltage source 22 to be conducted through the channel to the rotating electrode.

This low-resistance contact does not depend on any of: the current frequency of the corona discharge; the polarity of the power source 22; the frequency of rotation of the shaft 15 in the channel 27; or the water temperature. Therefore the proposed method is simpler and more efficient than methods previously used to provide an electrical contact between stationary and rotating elements.

The water consumption determined by the volumetric rate at which water is fed to the rotating electrode 16 depends on the rotational velocity of the electrode shaft 15, the length and pitch of the helical spiral 29 and the water level in the reservoir 24. All the parameters that determine the water consumption in the reservoir 24 are determined experimentally to ensure that the water level in the reservoir 24 are maintained constant during operation of the device, this being determined, for example, by means of an external dosage meter operating in a continuous or pulsed mode.

Hydrogen peroxide can be removed through the outlet 32 either continuously or periodically depending on the volume of the hydrogen peroxide collection reservoir 30. Since the housing 11 does not have air inlets and outlets, any ozone that is produced together with the hydrogen peroxide in the corona discharge zone in the gap 21 circulates inside the housing 11 without being released to the environment.

The inventor has constructed a pilot conversion device with the following parameters:

| | | |
|---|---|---|
| 1 | Material of the insulation layer | Glass |
| 2 | Distance between the electrodes | 1 mm |
| 3 | The electrode rotation velocity | 4000 RPM |
| 4 | AC voltage supply amplitude | ±5 kV |
| 5 | AC voltage supply frequency | 20 kHz |
| 6 | Water consumption | 300 ml/h |
| 7 | $H_2O_2$ concentration at the outlet of the device | 100 ppm |

The invention claimed is:

1. A method for conversion of water into hydrogen peroxide, said method comprising generation of corona discharge zone between a rotating electrode formed as a hollow rotor of a centrifugal fan and a fixed electrode, rotation of the rotating electrode relative to an insulation layer of the fixed electrode, applying high voltage AC power to the fixed electrode and conveying a water through the corona discharge zone;

characterized in that:

the rotating electrode is used for conversion of the water to the water vapor.

2. The method according to claim 1, wherein the rotating electrode is located inside the fixed electrode at a predetermined distance from the insulation layer thereof.

3. The method according to claim 1, wherein the rotating electrode is mounted on a shaft a lower end of which is located in a water reservoir.

4. The method according to claim 3, wherein a channel is used to convey the water to the rotating electrode with a lower end of the channel being located in the water reservoir and an upper end thereof located in a hollow cavity of the rotating electrode.

5. The method according to claim 4, wherein in order to elevate the water in the channel a helical spiral is provided on a lower end of the shaft, the shaft being mounted inside the channel.

6. The method according to claim 1, wherein the water is subject to a temperature drop as the water is converted to the water vapor and the temperature drop is used to cool the electrodes during vapor transmission through the corona discharge zone.

7. The method according to claim 1, wherein water conductivity between the fixed electrode and the rotating electrode induces electrolysis, which is used for high voltage AC transmission to the rotating electrode.

8. The method according to claim 3, wherein a shaft of the rotating electrode and a water feeding channel are used as electrodes.

9. The method according to claim 8, wherein at least portions of the shaft of the rotating electrode and the water feeding channel between which portions the water is located are made from conducting materials.

10. A device for converting water to hydrogen peroxide, said device comprising a housing accommodating a rotating electrode and a fixed electrode configured for connection to a high AC voltage source, the rotating electrode being formed as a hollow rotor of a centrifugal fan and configured for rotation relative to an insulation layer of the fixed electrode by an electric motor mounted in the housing, a water reservoir located in a lower portion of the housing and an outlet for removal of hydrogen peroxide from the device, wherein the rotating electrode is configured to convert the water into water vapor.

11. The device according to claim 10, wherein the rotating electrode is located inside the fixed electrode at a predetermined distance from the insulation layer thereof.

12. The device according to claim 10, wherein the rotating electrode is mounted on a shaft a lower end of which is located in a water reservoir.

13. The device according to claim 12, including a channel for conveying the water to the rotating electrode, said channel having a lower end located in the water reservoir and an upper end located in a hollow cavity of the rotating electrode.

14. The device according to claim 13, further including a helical spiral provided on a lower end of the shaft, the shaft being mounted inside the channel whereby rotation of the helical spiral in a predetermined direction elevates the water inside the channel.

15. The device according to claim 14, wherein at least portions of the shaft of the rotating electrode and the channel between which portions of the shaft the water is located are made from conducting materials.

16. The device according to claim 13, wherein a low voltage output of the AC high voltage source is connected to the channel.

* * * * *